US008177587B2

(12) United States Patent
Takagi et al.

(10) Patent No.: US 8,177,587 B2
(45) Date of Patent: May 15, 2012

(54) CONNECTOR WITH MOVABLE-SIDE CONTACT AND FIXED-SIDE CONTACT

(75) Inventors: Osamu Takagi, Tokyo (JP); Osamu Hashiguchi, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 68 days.

(21) Appl. No.: 12/880,356

(22) Filed: Sep. 13, 2010

(65) Prior Publication Data

US 2011/0065331 A1 Mar. 17, 2011

(30) Foreign Application Priority Data

Sep. 14, 2009 (JP) ..... 2009-212344

(51) Int. Cl.
*H01R 13/40* (2006.01)

(52) U.S. Cl. ..... 439/733.1; 439/74; 439/249

(58) Field of Classification Search ..... 439/733.1, 439/74, 249, 247

See application file for complete search history.

(56) References Cited

U.S. PATENT DOCUMENTS

| | | | | |
|---|---|---|---|---|
| 5,137,462 | A * | 8/1992 | Casey et al. | 439/74 |
| 6,561,821 | B1 * | 5/2003 | Yu | 439/74 |
| 6,695,622 | B2 * | 2/2004 | Korsunsky et al. | 439/65 |
| 7,351,071 | B2 * | 4/2008 | Korsunsky et al. | 439/74 |
| 2005/0032406 | A1 * | 2/2005 | Shiota et al. | 439/247 |

FOREIGN PATENT DOCUMENTS

JP 2008-198441 A 8/2008

* cited by examiner

*Primary Examiner* — Hae Moon Hyeon

(74) *Attorney, Agent, or Firm* — Holtz, Holtz, Goodman & Chick, PC

(57) ABSTRACT

A connector which makes it possible to accommodate positional displacement from a mating connector, and prevent the contact force and the amount of deformation of contacts from becoming too large. Fixed-side contacts are fixed to a fixed-side housings. A movable-side housing is assembled to the fixed-side housing slidably in a direction orthogonal to a fitting/removing direction in which the movable-side housing is fitted to and removed from the mating connector. Movable-side contacts each include first contact portions brought into contact with an associated one of the fixed-side contacts, and second contact portions brought into contact with an associated one of mating contacts of the mating connector. Contact-accommodating chambers for accommodating the movable-side contacts are formed in the movable-side housing such that each movable-side contact can be pivoted about a pivotal axis extending orthogonal to the fitting/removing direction.

8 Claims, 12 Drawing Sheets

CONNECTOR WITH MOVABLE-SIDE CONTACT AND FIXED-SIDE CONTACT

BACKGROUND OF THE INVENTION

1. Field of the Invention

This invention relates to a connector that is interposed between two objects to be connected, and electrically connects those objects to be connected to each other.

2. Description of the Related Art

Conventionally, there has been proposed a connector comprising a plurality of contacts, a first and second housing which hold these contacts (see Japanese Laid-Open Patent Publication (Kokai) No. 2008-198441: Paragraphs 0032, 0035, 0036, 0050, and 0051, and FIGS. 9 to 13).

The plurality of contacts are arranged in two rows, upper and lower, and the contacts in the upper row and the contacts in the lower row are arranged in a line-symmetric manner.

The plurality of contacts each include a first and second contact portion, a first and second spring portion, a first and second holding portion, and a floating portion.

When a card board and a motherboard are electrically connected to each other by using this connector, even if the card board is disposed relatively upward of the motherboard, or even if the card board is inclined with respect to the motherboard, a displacement between the both boards in a vertical direction or an inclination of the card board with respect to the motherboard is accommodated, through deformation of the contacts, whereby the contact of the first and second contact portions to both the boards is ensured.

However, in the above-described connector, the contact force of the first contact portions which are brought into contact with the card board sometimes becomes considerably larger than that of the second contact portions which are brought into contact with the motherboard, or the floating portion is sometimes largely deformed. Therefore, there are fears that operating force required in fitting the connector to the card board becomes large, and that the first and second contact portions and the floating portion are plastically deformed, causing degraded contact stability of the contact portions.

SUMMARY OF THE INVENTION

The present invention has been made in view of these circumstances, and an object thereof is to provide a connector which makes it possible to accommodate a positional displacement of the connector from a mating connector, and prevent the contact force and the amount of deformation of its contacts from becoming too large.

To attain the above object, the present invention provides a connector that can be fitted to a mating connector, comprising a fixed-side housing, a fixed-side contact fixed to the fixed-side housing, a movable-side housing that is assembled to the fixed-side housing in a manner slidable in a direction which is orthogonal to a fitting/removing direction in which the movable-side housing is fitted to and removed from the mating connector, and a movable-side contact including a first contact portion which is brought into contact with the fixed-side contact and a second contact portion which is brought into contact with a mating contact of the mating connector, wherein the movable-side housing includes a contact-accommodating hole which extends in the fitting/removing direction, and accommodates the movable-side contact such that the movable-side contact can be pivoted about a pivotal axis extending in a direction orthogonal to the fitting/removing direction.

With the arrangement of the connector according to the present invention, when the movable-side housing is fitted to the mating connector, the movable-side housing is allowed to be slid in the direction which is orthogonal to the fitting/removing direction, so that the movable-side contact can be pivoted about the pivotal axis which is orthogonal to the fitting/removing direction and the sliding direction of the movable-side housing, and hence the movable-side contact is hardly deformed, and the contact force of the first and second contact portions which are brought into contact with the fixed-side contact and the mating contact, respectively, is prevented from becoming too large.

Preferably, the movable-side contact includes a linking portion linking the first contact portion and the second contact portion and pivotally supported by the fixed-side housing and the movable-side housing.

Preferably, the first and second contact portions are shaped such that the first and second contact portions hold the fixed-side contact and the mating contact, respectively, in a sandwiching manner.

Preferably, the connector comprises wobble-suppressing means for suppressing the second contact portion from wobbling when the movable-side contact is pivoted.

According to this invention, it is possible to accommodate the displacement from the mating connector, and prevent the contact force and the amount of deformation of the contacts from becoming too large.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof. A description will be given of a connector according to an embodiment of the present invention with reference to FIGS. 1 to 12.

Figure 1:
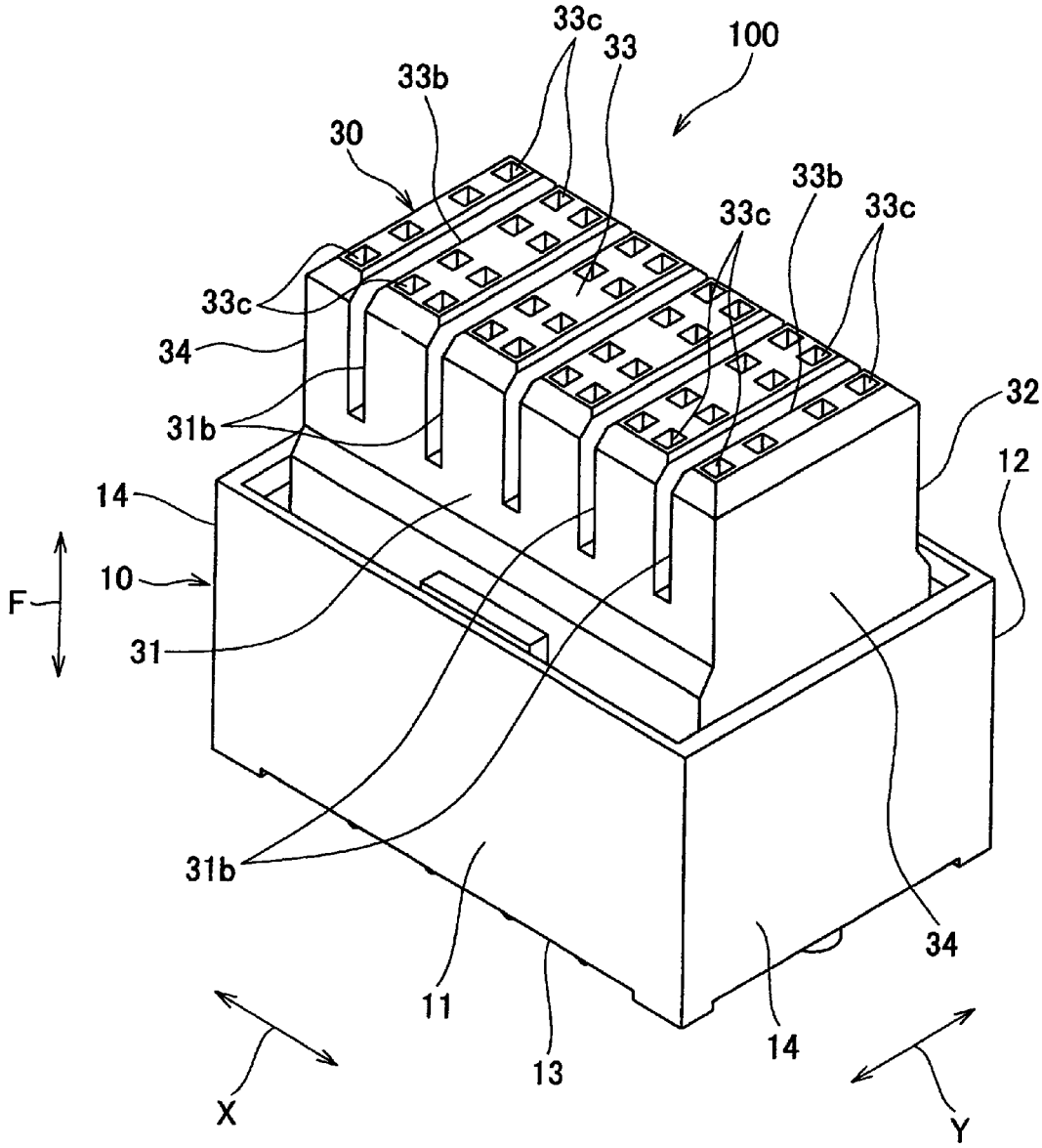
FIG. 1 is a perspective view of a connector according to an embodiment of the present invention.
Figure 2:
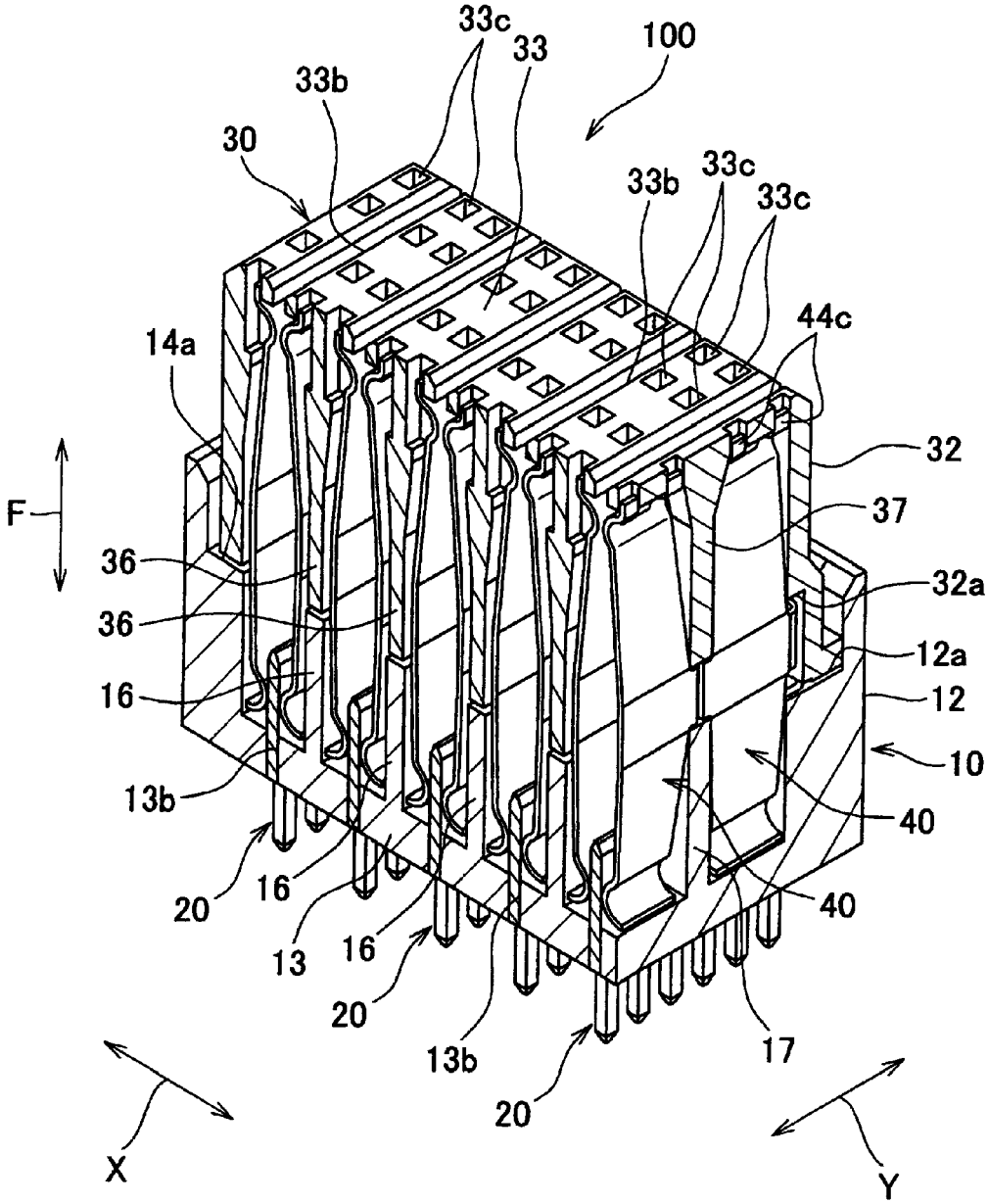
FIG. 2 is a perspective view of the connector shown in FIG. 1 in a partially cut away state.

As shown in FIGS. 1 and 2, a connector 100 comprises a fixed-side housing 10, a plurality of fixed-side contacts 20, a movable-side housing 30, and a plurality of movable-side contacts 40. The connector 100 is mounted on a printed circuit board, not shown, and is capable of being fitted and removed to and from a mating connector 900 (see FIG. 3).

As shown in FIGS. 1, 2, 5, and 12, the fixed-side housing 10 is box-shaped, and an upper part thereof (upper part of the fixed-side housing 10 as viewed in FIG. 2) is open. The fixed-side housing 10 is integrally formed of insulating resin. The fixed-side housing 10 includes a front portion 11, a rear portion 12, a bottom portion 13, and side portions 14 and 14.

Figure 12:
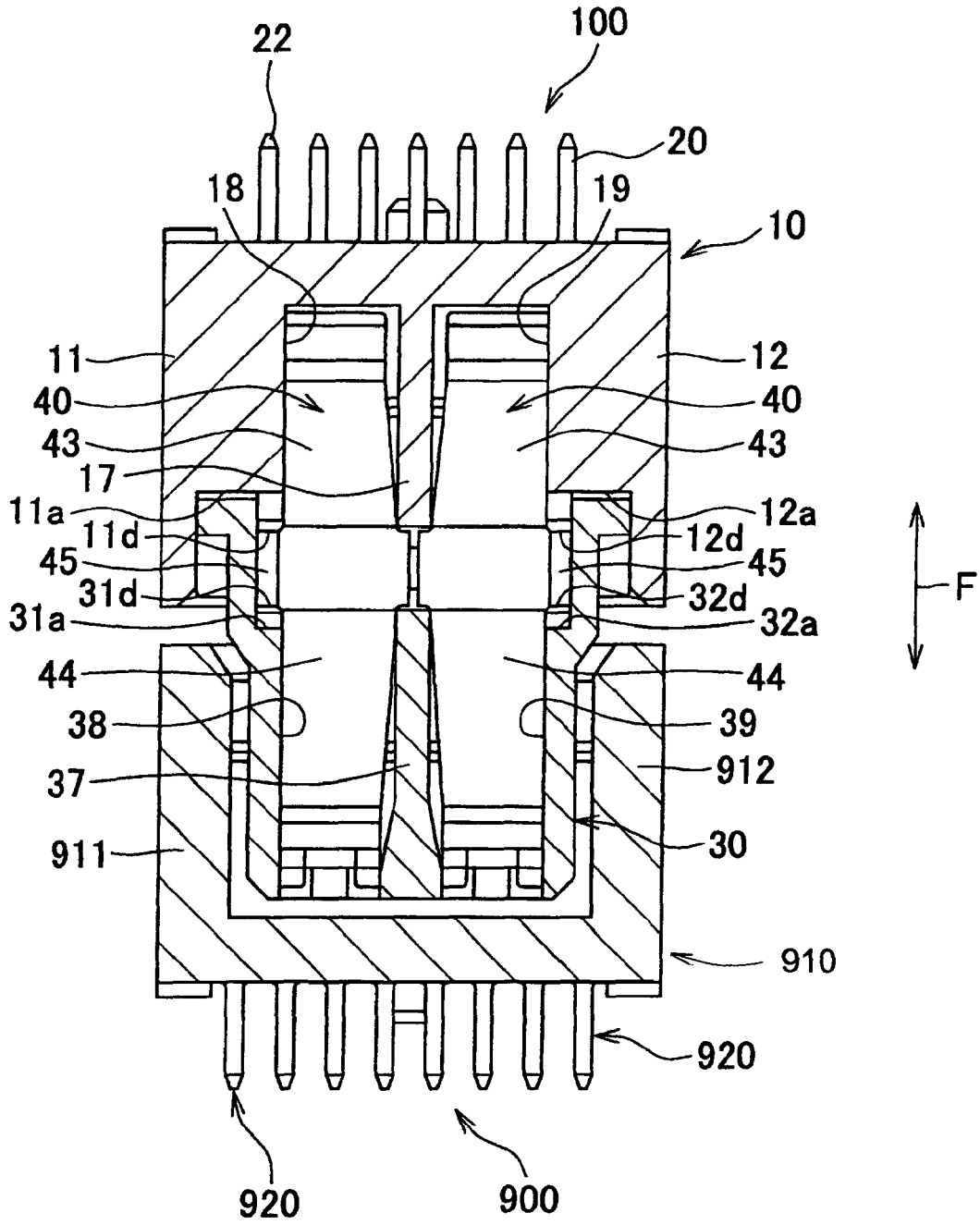
FIG. 12 is a cross-sectional view of the connector and the mating connector, shown in FIG. 10.

The front portion 11 is not uniform in thickness thereof, that is, a lower portion thereof (upper portion of a left-side portion of the fixed-side housing 10 as viewed in FIG. 12) is thick, and an upper portion thereof (lower portion of the left-side portion of the fixed-side housing 10 as viewed in FIG. 12) is thin. A step surface 11*a* is formed on an inner surface of the front portion 11, and is formed with protrusions 11*d* (see FIG. 12). Each protrusion 11*d* has an arc-shaped end.

The rear portion 12 has the same shape as that of the front portion 11, that is, a lower portion thereof (upper portion of a right-side portion of the fixed-side housing 10 as viewed in FIG. 12) is thick, and an upper portion thereof (lower portion of the right-side portion of the fixed-side housing 10 as viewed in FIG. 12) is thin. A step surface 12*a* is formed on an inner surface of the rear portion 12. The step surface 12*a* of the rear portion 12 is disposed at the same position as the step surface 11*a* of the front portion 11 in a direction of the height of the fixed-side housing 10 (direction parallel to a fitting/removing direction F in which the connector 100 is fitted to and removed from the mating connector 900 (see FIG. 3)). The step surface 12*a* is formed with protrusions 12*d* (see FIG. 12). Each protrusion 12*d* has an arc-shaped end.

The bottom portion 13 is formed with slits 13*b* at equally-spaced intervals along an X direction (direction orthogonal to the fitting/removing direction F). The slits 13*b* extend in a Y direction (direction orthogonal to the fitting/removing direction F and the X direction) (see FIG. 2).

The opposite side portions 14 and 14 are each formed with a step surface 14*a* (see FIGS. 2 and 5), similarly to the front portion 11 and the rear portion 12. The step surface 14*a* of each side portion 14 is disposed at the same position as the step surface 11*a* of the front portion 11 in the direction of the height of the fixed-side housing 10.

Figure 5:
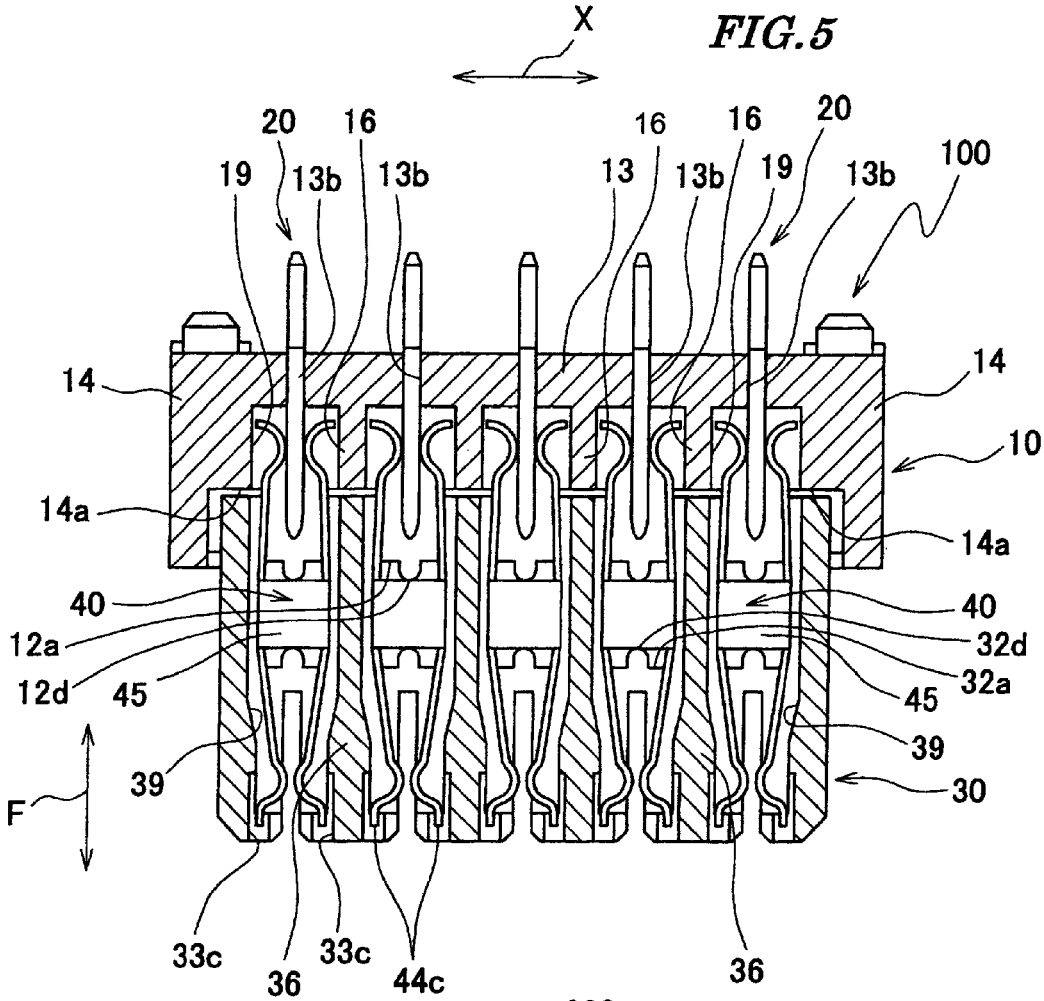
FIG. 5 is a cross-sectional view of the connector shown in FIG. 1 and the mating connector shown in FIG. 3 in a state before they are fitted to each other.
Figure 5:
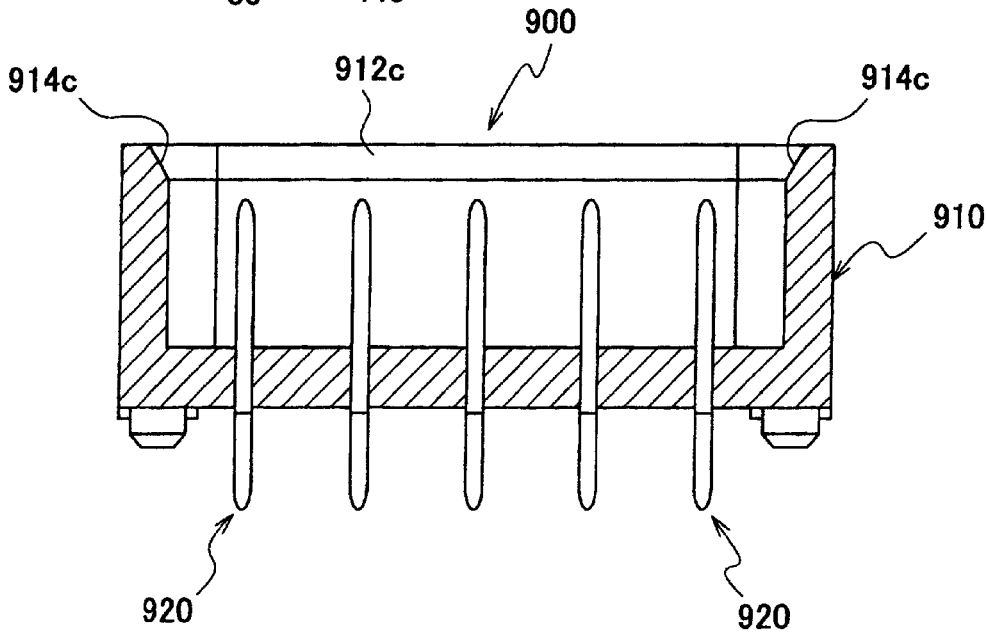
Figure 6:
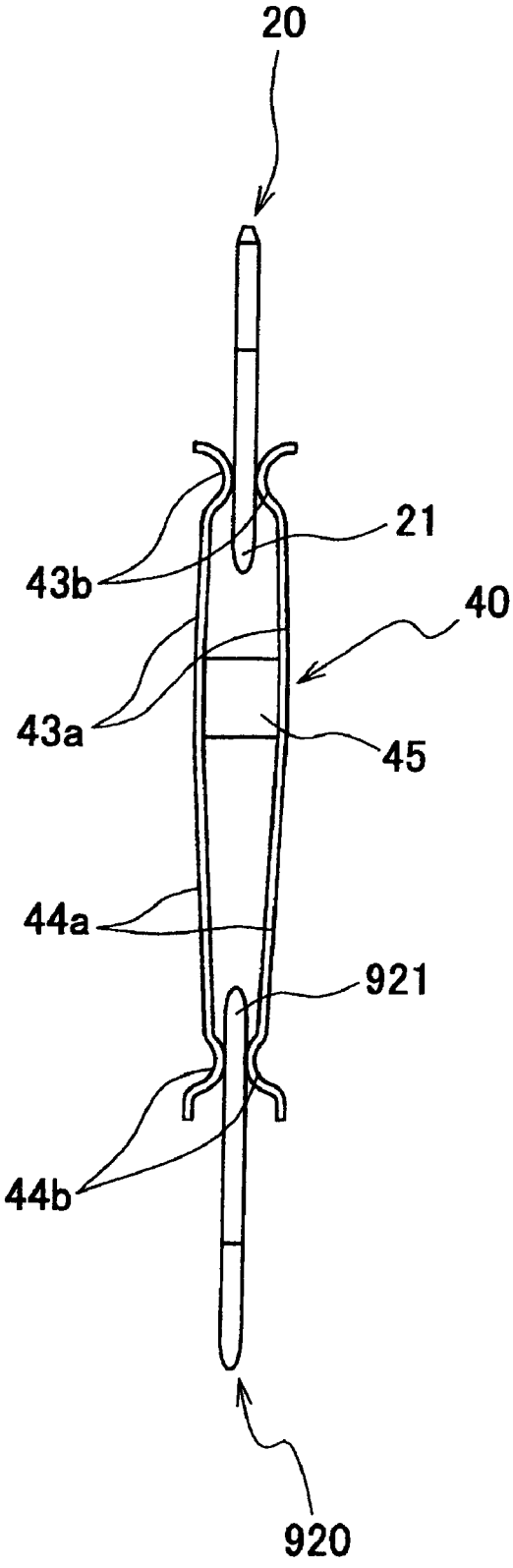
FIG. 6 is a schematic view of a fixed-side contact, a movable-side contact, and a mating contact, in a contact state.

A plurality of partitions 16 are formed within the fixed-side housing 10 at equally-spaced intervals along the X direction (see FIG. 5). Each partition 16 is arranged between two adjacent ones of the slits 13*b*.

Further, a center partition 17 which is orthogonal to the plurality of partitions 16 is formed within the fixed-side housing 10 (see FIG. 2). A space within the fixed-side housing 10 is partitioned by the plurality of partitions 16 and the center partition 17 into a plurality of spaces which form a plurality of accommodating chambers 18 and 19 (see FIG. 12). The plurality of accommodating chambers 18 and the plurality of accommodating chambers 19 are respectively arranged along the X direction. Each accommodating chamber 18 and each accommodating chamber 19 are communicated with an associated one of the slits 13*b*.

Figure 7:
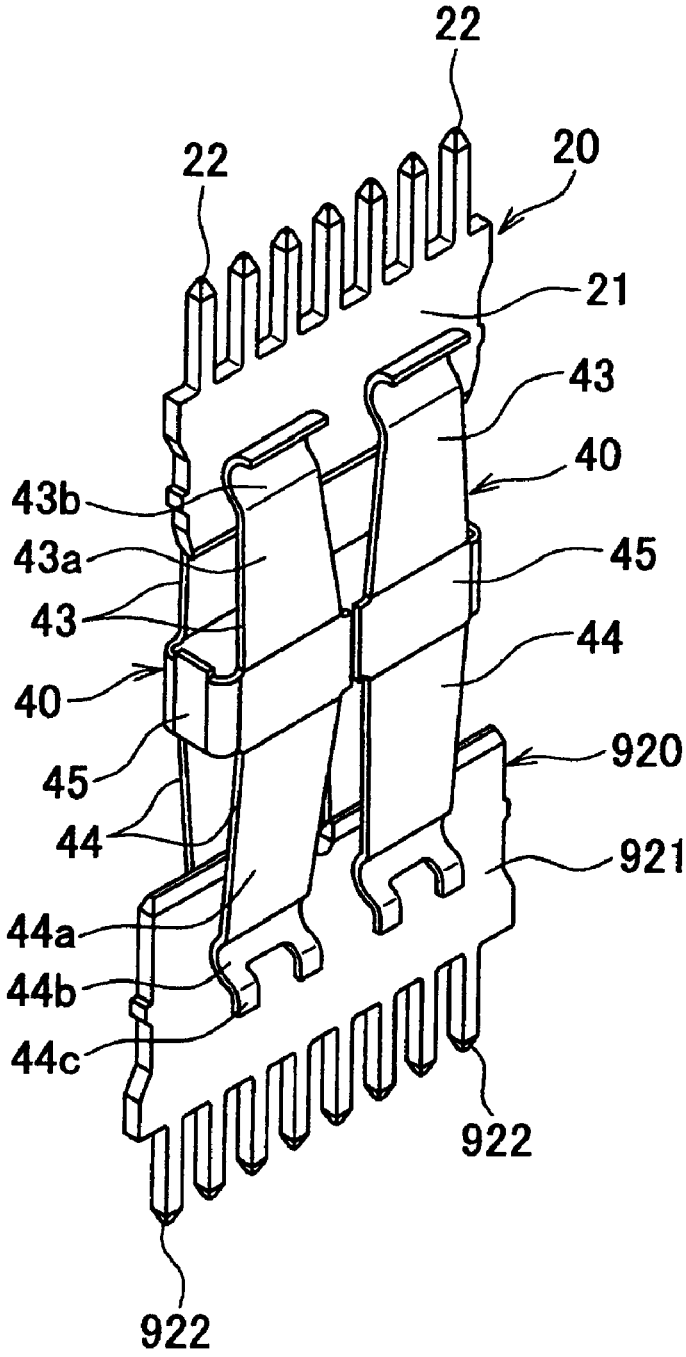
FIG. 7 is a perspective view of the fixed-side contact, the movable-side contact, and the mating contact, in the contact state.

As shown in FIGS. 2 and 7, the fixed-side contacts 20 each include a contact portion 21 and a plurality of connection portions 22. The contact portion 21 and the plurality of connection portions 22 are integrally formed. The contact portion 21 is plate-shaped. The plurality of connection portions 22 are each pin-shaped, and are continuous with the contact portion 21 at equally-spaced intervals.

The fixed-side contacts 20 are press-fitted in the respective slits 13*b* of the bottom portion 13 of the fixed-side housing 10 (see FIG. 2).

As shown in FIGS. 1, 2, 5, and 12, the movable-side housing 30 is box-shaped, and a lower part thereof (upper part of the movable-side housing 30 as viewed in FIG. 12) is open. The movable-side housing 30 is integrally formed of insulating resin. The movable-side housing 30 includes a front portion 31, a rear portion 32, au upper portion 33, and side portions 34 and 34 (see FIG. 1).

Step surfaces 31*a* and 32*a* are formed on respective inner surfaces of the front portion 31 and the rear portion 32 of the movable-side housing 30. The step surfaces 31*a* and 32*a* are formed with protrusions 31*d* and 32*d*, respectively (see FIGS. 5 and 12). Each of the protrusions 31*d* and 32*d* has an arc-shaped end.

The linking portion 45 of each movable-side contact 40 is freely movably arranged between an associated one of the protrusions 31*d* or 32*d* and an associated one of the protrusions 11*d* or 12*d* that are formed on the fixed-side housing 10 as described previously.

As shown in FIG. 1, the front portion 31 is formed with a plurality of slits 31*b* at equally-spaced intervals along the X direction. The slits 31*b* extend in the fitting/removing direction F.

The rear portion 32 is formed with a plurality of slits (not shown) at equally-spaced intervals along the X direction. The slits of the rear portion 32 extend in the fitting/removing direction F. The slits of the rear portion 32 are opposite to the slits 31*b* of the front portion 31 in the Y direction, respectively.

The upper portion 33 is formed with a plurality of slits 33*b* at equally-spaced intervals along the X direction. The slits 33*b* extend in the Y direction. One end of each slit 33*b* is communicated with an associated one of the slits 31*b* of the front portion 31, and the other end of each slit 33*b* is communicated with an associated one of the slits of the rear portion 32. A plurality of holes 33*c* are formed in the movable-side housing 30 on opposite sides of each slit 33*b*, at predetermined intervals along the Y direction.

A plurality of partitions 36 are formed within the movable-side housing 30 at equally-spaced intervals along the X direction (see FIG. 5). Each partition 36 is arranged between two adjacent ones of the slits 33*b*. The partitions 36 are opposed to the partitions 16 of the fixed-side housing 10 in the fitting/removing direction F.

Further, a center partition 37 which is orthogonal to the plurality of partitions 36 is formed within the movable-side housing 30 (see FIG. 12). A space within the movable-side housing 30 is partitioned by the plurality of partitions 36 and the center partition 37 into a plurality of spaces which form a plurality of contact-accommodating chambers (contact-accommodating holes) 38 and 39. The plurality of contact-accommodating chambers 38 and the plurality of contact-accommodating chambers 39 are respectively arranged along the X direction. The contact-accommodating chambers 38 and 39 are each communicated with an associated one of the slits 33*b* and associated ones of the holes 33*c*. Further, the contact-accommodating chambers 38 are continuous with the accommodating chambers 18, and the contact-accommodating chambers 39 are continuous with the accommodating chambers 19, respectively (see FIG. 12).

The front portion 31 and the rear portion 32 of the movable-side housing 30 have respective protruding portions (not shown) formed on the respective outer surfaces. The front portion 11 and the rear portion 12 of the fixed-side housing 10 have recesses (not shown) formed in the respective inner surfaces. These recesses extend in the X direction, and by fitting the protruding portions of the movable-side housing 30 into the respective recesses of the fixed-side housing 10, the lower part of the movable-side housing 30 is assembled to the fixed-side housing 10 in a manner slidable in the X direction.

As shown in FIGS. 2 and 7, the movable-side contacts 40 each include a pair of first contact portions 43, a pair of second contact portions 44, and the linking portion 45. Each movable-side contact 40 is formed by blanking and bending a metal plate.

The pair of first contact portions 43 each include a spring portion 43*a* and a contact point portion 43*b*. The spring portion 43*a* urges the contact point portion 43*b* against the contact portion 21 of an associated one of the fixed-side contacts 20. The contact point portion 43*b* is bent into an arc-shape, and is brought into contact with the contact portion 21 of the associated one of the fixed-side contacts 20.

The pair of second contact portions 44 each include a spring portion 44*a*, a contact point portion 44*b*, and a pair of protruding portions 44*c*. The spring portion 44*a* urges the contact point portion 44*b* against a contact portion 921 of an associated one of mating contacts 920, referred to hereinafter. The contact point portion 44*b* is bent into a substantially arc-shape, and is brought into contact with the contact portion 921 of the associated one of the mating contacts 920. The pair of protruding portions 44*c* are each bent into a substantially L-shape, and are continuous with the contact point portion 44*b*. The pair of protruding portions 44*c* are inserted in the associated holes 33*c* of the upper portion 33 of the movable-side housing 30, respectively (see FIG. 5). The pair of protruding portions 44*c* and the associated holes 33*c* form wobble-suppressing means which suppresses wobbling of the second contact portions 44 of each movable-side contact 40 when the movable-side housing 30 is slid.

The linking portion 45 links the pair of first contact portions 43 and the pair of second contact portions 44.

The movable-side contacts 40 are accommodated in the contact-accommodating chambers 38 and 39 of the movable-side housing 30. The linking portion 45 of each movable-side contact 40 in the associated contact-accommodating chamber 38, as shown in FIG. 12, is arranged between the associated one of the protrusions 11*d* of the fixed-side housing 10 and the associated one of the protrusions 31*d* of the movable-side housing 30, and at the same time is arranged between the center partition 17 of the fixed-side housing 10 and the center partition 37 of the movable-side housing 30. Each movable-side contact 40 is capable of pivoting about a pivotal axis parallel to the Y direction only within a predetermined range in the associated contact-accommodating chamber 38.

Further, each movable-side contact 40 is capable of slightly pivoting about a pivotal axis parallel to the X direction in the contact-accommodating chamber 38.

As shown in FIG. 12, the movable-side contacts 40 accommodated in the contact-accommodating chambers 39 are oriented oppositely to the movable-side contacts 40 accommodated in the contact-accommodating chambers 38. The linking portion 45 of each movable-side contact 40 in each contact-accommodating chamber 39 is arranged between the associated one of the protrusions 12*d* of the fixed-side housing 10 and the associated one of the protrusions 32*d* of the movable-side housing 30, and at the same time is arranged between the center partition 17 of the fixed-side housing 10 and the center partition 37 of the movable-side housing 30. Each movable-side contact 40 is capable of pivoting about the pivotal axis parallel to the Y direction only within a predetermined range in each contact-accommodating chamber 39.

Figure 3:
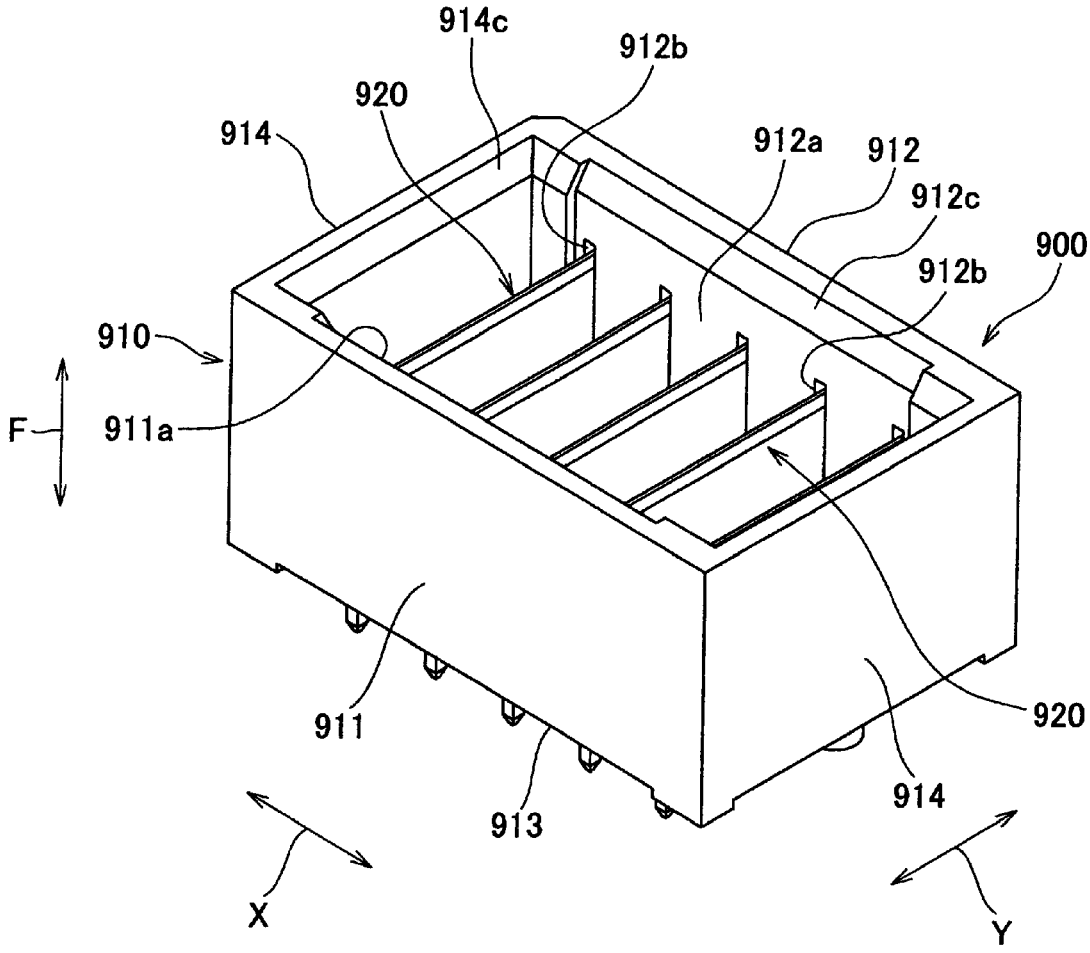
FIG. 3 is a perspective view of a mating connector.
Figure 4:
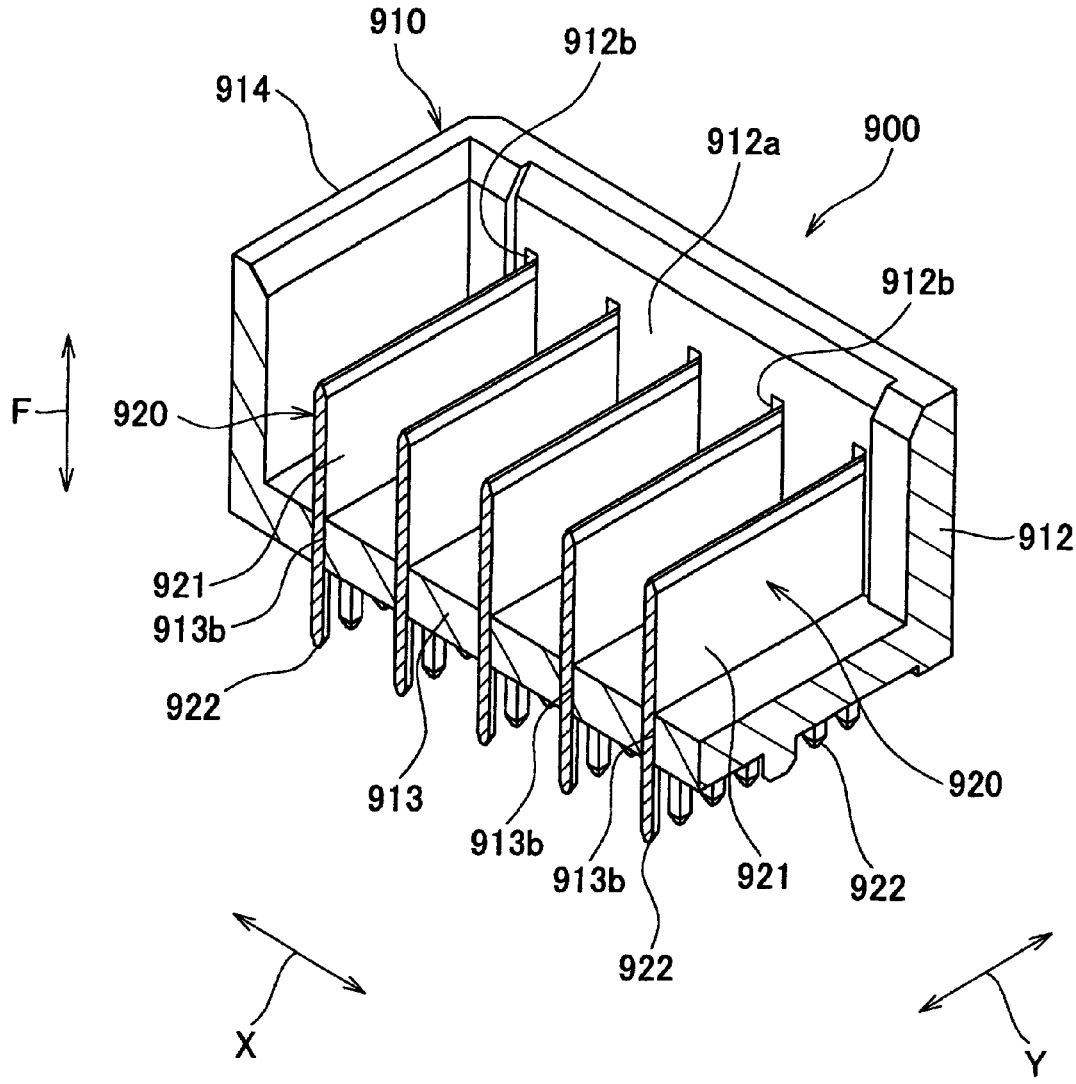
FIG. 4 is a perspective view of the mating connector shown in FIG. 3 in a partially cut away state.

As shown in FIGS. 3 and 4, the mating connector 900 comprises a mating housing 910 and the plurality of mating contacts 920.

The mating housing 910 is box-shaped, and an upper part thereof is open. The mating housing 910 is integrally formed of insulating resin. The mating housing 910 includes a front portion 911, a rear portion 912, a bottom portion 913, and side portions 914 and 914.

An inner surface of the front portion 911 and an inner surface of the rear portion 912 are distanced such that the movable-side housing 30 can move slightly in the Y direction therebetween. The inner surface of the rear portion 912 is formed further with a recess 912*a* therein to prevent a warpage of the rear portion 912 from reducing its intended distance from the inner surface of the front portion 911. Further, grooves 912*b* are formed in the inner surface of the rear portion 912 at equally-spaced intervals along the X direction. The grooves 912*b* extend in the fitting/removing direction F. Further, the rear portion 912 has a guiding surface 912*c* formed on a top end portion thereof.

An inner surface of the front portion 911 is formed with a recess 911*a*, grooves (not shown), and a guiding surface (not shown), similarly to the inner surface of the rear portion 912. The grooves of the front portion 911 are formed in the inner surface of the front portion 911 at equally-spaced intervals along the X direction, and extend in the fitting/removing direction F.

The bottom portion 913 is formed with slits 913*b* at equally-spaced intervals along the X direction. The slits 913*b* extend in the Y direction. One end of each slit 913*b* is communicated with an associated one of the grooves (not shown) of the front portion 911, and other end of each slit 913*b* is communicated with an associated one of the grooves 912*b* of the rear portion 912.

The opposite side portions 914 each have a guiding surface 914*c* formed on a top end portion thereof (see FIG. 5).

As shown in FIGS. 4 and 7, the mating contacts 920 each include the contact portion 921 and a plurality of connection portions 922. The contact portion 921 and the connection portions 922 are integrally formed. The contact portion 921 is plate-shaped. The plurality of connection portions 922 are each pin-shaped, and are continuous with the contact portion 921 at equally-spaced intervals.

The mating contacts 920 are press-fitted into the slits 913*b* of the bottom portion 913 of the mating housing 910.

Next, a description will be given of the operation of the above-described connector 100.

It should be noted that the connector 100 is mounted on a printed circuit board, not shown, and the connection portions 22 of the fixed-side contacts 20 are inserted and soldered to through holes of the printed circuit board. The mating connector 900 is mounted on another printed circuit board, not shown, and the connection portions 922 of the mating contacts 920 are inserted and soldered to through holes of the another printed circuit board.

As shown in FIG. 5, the connector 100 and the mating connector 900 are made opposed to each other and are then fitted to each other.

Figure 8:
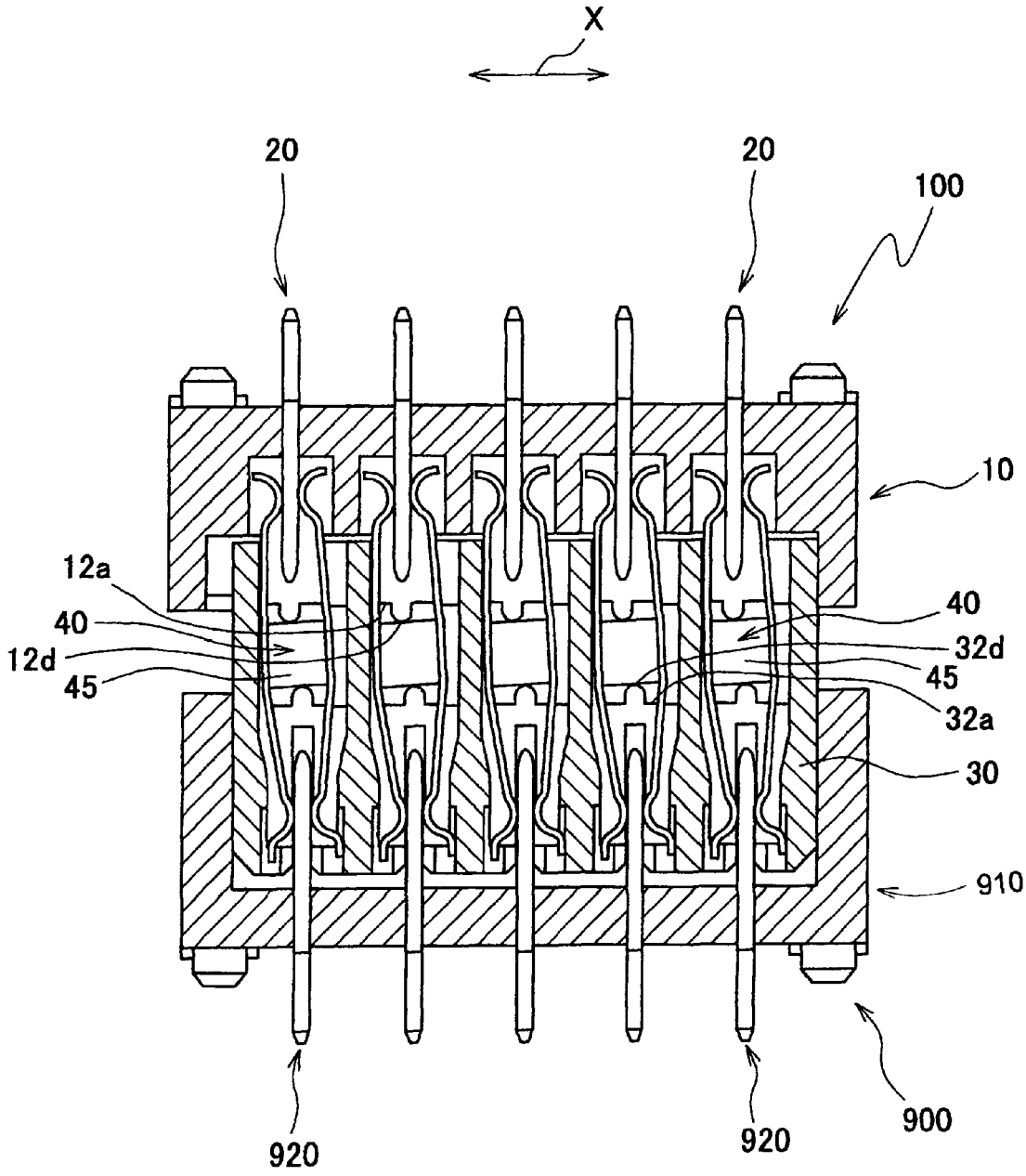
FIG. 8 is a cross-sectional view of the connector shown in FIG. 1 and the mating connector shown in FIG. 3 in a state fitted to each other.

At this time, even if the center of the connector 100 and the center of the mating connector 900 are displaced in the X direction, the movable-side housing 30 is slid with respect to the fixed-side housing 10 as shown in FIG. 8, whereby the movable-side housing 30 and the mating housing 910 are fitted to each other. The movable-side housing 30 is not inclined with respect to the fitting/removing direction F. Further, there are spaces between the front portion 31 of the movable-side housing 30 and the front portion 911 of the mating housing 910, and between the rear portion 32 of the movable-side housing 30 and the rear portion 912 of the mating housing 910, respectively, whereby the movable-side housing 30 can be moved in the Y direction, and hence the displacement of the connector 100 and the mating connector 900 in the Y direction is accommodated.

Figure 9:
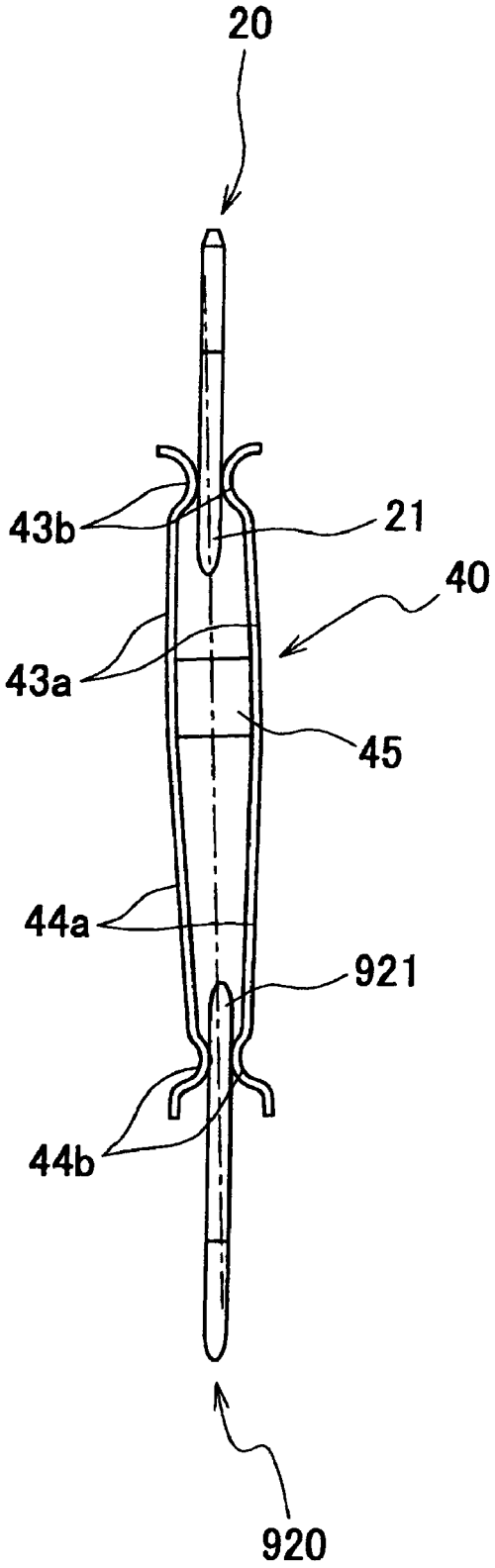
FIG. 9 is a schematic view of the fixed-side contact, the movable-side contact, and the mating contact, appearing in FIG. 8, in the contact state.
Figure 10:
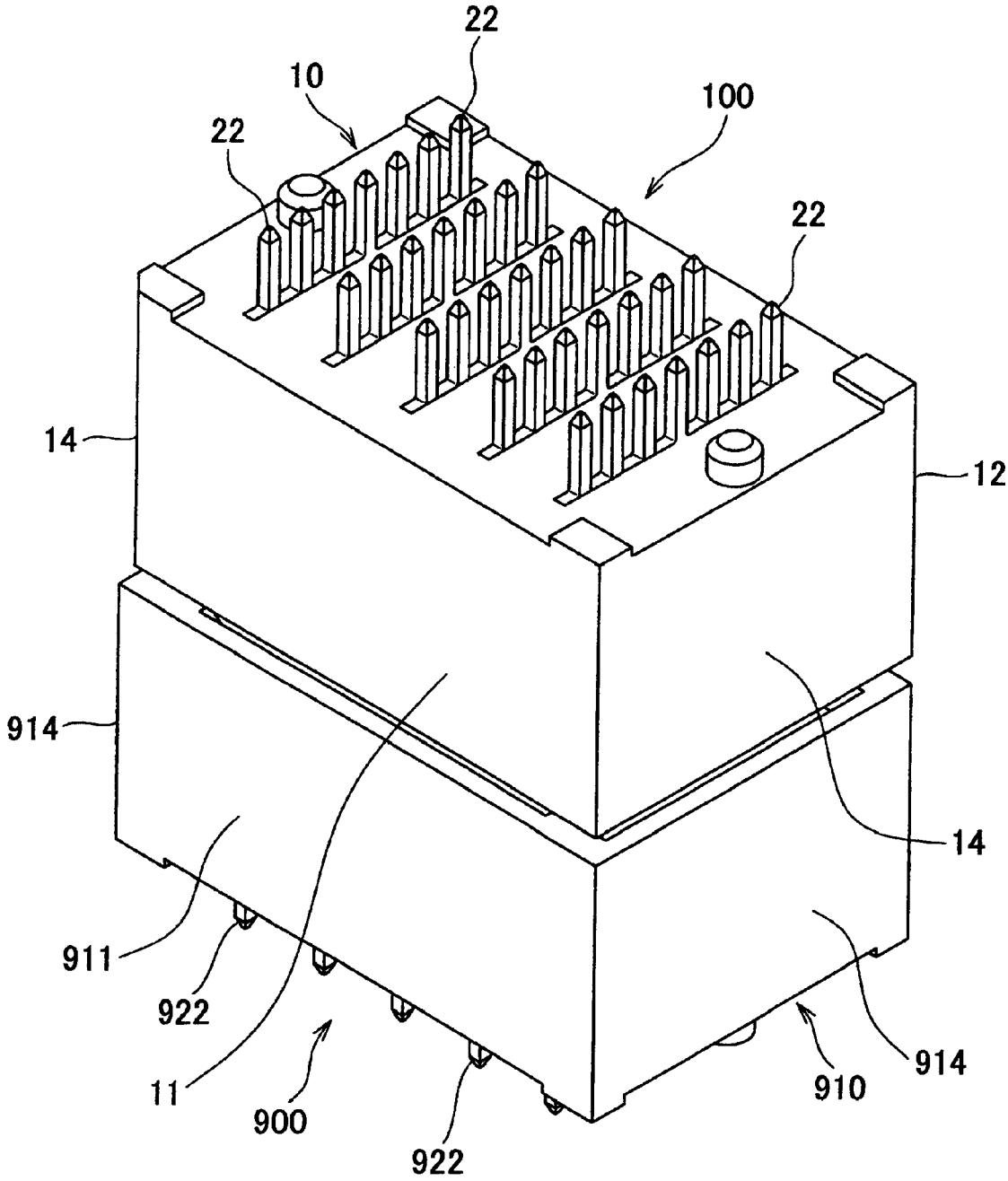
FIG. 10 is a perspective view of the connector shown in FIG. 1 and the mating connector shown in FIG. 3 in the state fitted to each other.
Figure 11:
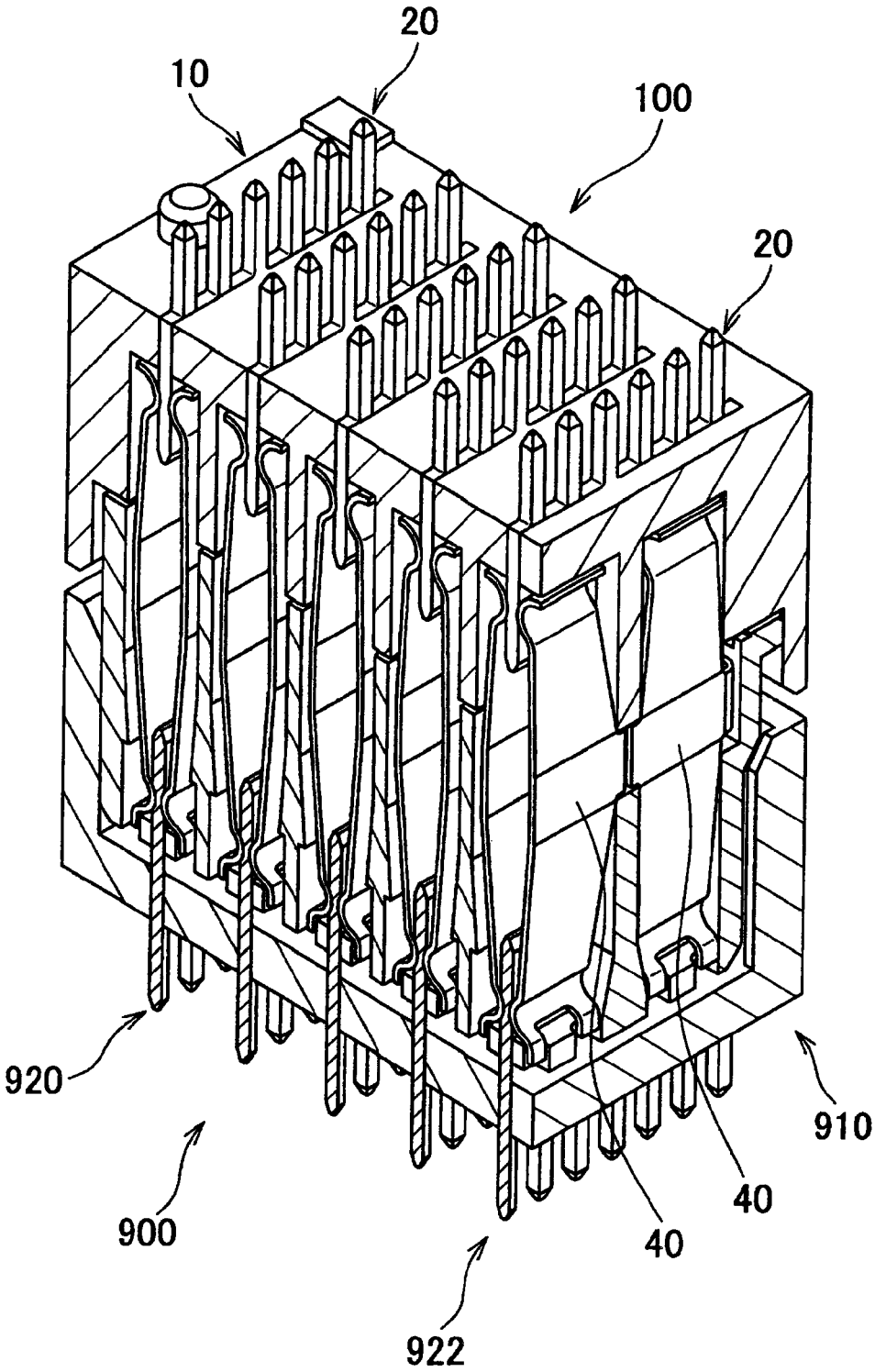
FIG. 11 is a perspective view of the connector and the mating connector, shown in FIG. 10, in a partially cut away state.

When the movable-side housing 30 is slid to the right side with respect to the fixed-side housing 10 as shown in FIG. 8, each movable-side contact 40 is only pivoted in an anticlockwise direction about the linking portion 45 as shown in FIG. 9, and is hardly elastically deformed. Therefore, as compared with a case where the center of the connector 100 and the center of the mating connector 900 are not displaced in the X direction, the contact force generated between the contact portion 21 of each fixed-side contact 20 or the contact portion 921 of each mating contact 920 and the associated movable-side contact 40 is hardly changed.

According to the present embodiment in which the movable-side contacts 40 are pivoted, when the connector 100 is fitted to the mating connector 900, the contact force generated between the contact portion 21 of each fixed-side contact 20 or the contact portion 921 of each mating contact 920 and the associated movable-side contact 40 is hardly changed.

Therefore, even if the center of the connector 100 and the center of the mating connector 900 are displaced, it is possible to fit the connector 100 to the mating connector 900 by a small force. Further, there is almost no change in the amount of deformation of each movable-side contact 40 between when the connector 100 and the mating connector 900 are fitted to each other with the center of the connector 100 and the center of the mating connector 900 being displaced in the Y direction, and when the connector 100 and the mating connector 900 are fitted to each other with the center of the connector 100 and the center of the mating connector 900 being not displaced in the Y direction, and hence it is possible to prevent each movable-side contact 40 from being plastically deformed, which makes it possible to maintain the contact stability.

Further, in order to reduce the force required for inserting and removing the connector, differently from the conventional connector, each contact need not be made long and narrow so as to increase the amount of displacement of a displacement portion of the contact, which makes it possible to reduce the size of the movable-side housing 30 and easily make the connector 100 compact in size.

Further, by making each movable-side contact 40 thick instead of reducing the size of the movable-side housing 30, it is possible to use the connector 100 as a high current capacity connector.

Further, the protruding portions 44*c* of each movable-side contact 40 are inserted in the associated holes 33*c* of the movable-side housing 30, and hence it is possible to suppress the second contact portions 44 of each movable-side contact 40 from largely wobbling in the contact-accommodating chambers 38 and 39.

It should be noted that although in the above-described embodiment, the linking portion 45 of each movable-side contact 40 is pivotally supported by the fixed-side housing 10 and the movable-side housing 30, it is not necessarily required to support the linking portion 45 by the fixed-side housing 10 and the movable-side housing 30. For example, the linking portion 45 may be supported only by the movable-side housing 30.

Further, although in the above-described embodiment, the first contact portions 43 and the second contact portions 44 of each movable-side contact 40 are shaped such that they hold an associated one of the fixed-side contacts 20 and an associated one of the mating contacts 920 in a sandwiching manner, the respective shapes of the first and second contact portions 43 and 44 are not limited to those for holding the fixed-side contact 20 and the mating contact 920 in a sandwiching manner.

It should be noted that although in the above-described embodiment, the protruding portions 44*c* of each movable-side contact 40 and the holes 33*c* of the movable-side housing 30, into which the protruding portions 44*c* are inserted, form the wobble-suppressing means, the construction of the wobble-suppressing means is not limited to this.

Although in the above-described embodiment, the protrusions 11*d* and 12*d*, and 31*d* and 32*d* are formed on the fixed-side housing 10 and the movable-side housing 30, respectively, the protrusions 11*d*, 12*d*, 31*d*, and 32*d* may be formed on the linking portion 45 of each movable-side contact 40. In this case, the fixed-side housing 10 and the movable-side housing 30 are only formed with the step surfaces 11*a* and 12*a*, and 31*a* and 32*a*, respectively.

Further, although the respective ends of the protrusions 11*d*, 12*d*, 31*d*, and 32*d* are arc-shaped, they may be angle-shaped, that is, the shape of the end is not limited to an arc.

It is further understood by those skilled in the art that the foregoing are the preferred embodiments of the present invention, and that various changes and modification may be made thereto without departing from the spirit and scope thereof.

What is claimed is:

1. A connector that can be fitted to a mating connector, comprising:

a fixed-side housing;

a fixed-side contact fixed to said fixed-side housing;

a movable-side housing that is assembled to said fixed-side housing in a manner slidable in a direction which is orthogonal to a fitting/removing direction in which said movable-side housing is fitted to and removed from the mating connector; and a movable-side contact including a first contact portion which is brought into contact with said fixed-side contact and a second contact portion which is brought into contact with a mating contact of the mating connector, wherein said movable-side housing includes a contact-accommodating hole which extends in the fitting/removing direction, and accommodates said movable-side contact such that said movable-side contact can be pivoted about a pivotal axis extending in a direction orthogonal to the fitting/removing direction.

2. The connector as claimed in claim 1, wherein said movable-side contact includes a linking portion linking said first contact portion and said second contact portion and pivotally supported by said fixed-side housing and said movable-side housing.

3. The connector as claimed in claim 1, wherein said first and second contact portions are shaped such that said first and second contact portions hold said fixed-side contact and the mating contact, respectively, in a sandwiching manner.

4. The connector as claimed in claim 2, wherein said first and second contact portions are shaped such that said first and second contact portions hold said fixed-side contact and the mating contact, respectively, in a sandwiching manner.

5. The connector as claimed in claim 1, comprising wobble-suppressing means for suppressing said second contact portion from wobbling when said movable-side contact is pivoted.

6. The connector as claimed in claim 2, comprising wobble-suppressing means for suppressing said second contact portion from wobbling when said movable-side contact is pivoted.

7. The connector as claimed in claim 3, comprising wobble-suppressing means for suppressing said second contact portion from wobbling when said movable-side contact is pivoted.

8. The connector as claimed in claim 4, comprising wobble-suppressing means for suppressing said second contact portion from wobbling when said movable-side contact is pivoted.

* * * * *